US009243362B2

(12) United States Patent
Winkelmann et al.

(10) Patent No.: US 9,243,362 B2
(45) Date of Patent: Jan. 26, 2016

(54) METHOD FOR MOUNTING A PANEL OF AN APPLIANCE, ESPECIALLY OF A DOMESTIC APPLIANCE

(75) Inventors: Klaus Winkelmann, Gedern (DE); Heiko Meissner, Ansbach (DE); Herbert Michel, Rothenburg (DE); Jurgen Feser, Furth (DE); Gerhard Schaff, Cadolzburg (DE); Michael Knab, Rothenburg (DE)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 395 days.

(21) Appl. No.: 13/640,796

(22) PCT Filed: May 11, 2011

(86) PCT No.: PCT/EP2011/002334

§ 371 (c)(1),
(2), (4) Date: Oct. 12, 2012

(87) PCT Pub. No.: WO2011/147532

PCT Pub. Date: Dec. 1, 2011

(65) Prior Publication Data

US 2013/0056146 A1 Mar. 7, 2013

(30) Foreign Application Priority Data

May 28, 2010 (EP) ..... 10005606

(51) Int. Cl.

| | |
|---|---|
| ***B32B 37/12*** | (2006.01) |
| ***D06F 39/00*** | (2006.01) |
| ***A47L 15/42*** | (2006.01) |
| ***F24C 7/08*** | (2006.01) |

(52) U.S. Cl.

CPC ..... *D06F 39/005* (2013.01); *A47L 15/4293* (2013.01); *F24C 7/082* (2013.01); *Y10T 156/10* (2015.01)

(58) Field of Classification Search

CPC .... B32B 37/00; B32B 1/00; B32B 17/10807; B32B 37/12; B32B 37/1207; B32B 27/1284; B32B 37/1292

USPC ..... 156/275.5; 219/520; 68/3 R, 12.01

See application file for complete search history.

(56) References Cited

U.S. PATENT DOCUMENTS 6,210,522 B1 * 4/2001 Singh et al. ..... 347/50
8,333,862 B2 * 12/2012 Thompson et al. ..... 156/273.7

(Continued)

FOREIGN PATENT DOCUMENTS

DE 102005024934 12/2006
DE 102007041059 9/2008

(Continued)

OTHER PUBLICATIONS

JP 62035107 A English abstract, Feb. 1987.*

(Continued)

*Primary Examiner* — Richard Crispino
*Assistant Examiner* — Elizabeth Bradford
(74) *Attorney, Agent, or Firm* — Pearne & Gordon LLP

(57) ABSTRACT

The invention relates to a method for mounting a panel (1) of an appliance, especially of a domestic appliance, comprising the steps: a) Arranging of a panel element (2); b) Applying a first adhesive (3) and a second adhesive (4) onto a surface of the panel element (2); c) Pressing a transparent pane element (5) against the surface of the panel element (2) in a mounting position so that the first and the second adhesive (3, 4) have contact with the panel element (2) as well as with the pane element (5); d) Activating the adhesion of the second adhesive (4) to bond the pane element (5) with the panel element (2); e) Applying a third adhesive (6) and a fourth adhesive (7) onto a surface of the pane element (5); f) Pressing a frame element (8) against the surface of the pane element (5) in a mounting position so that the third and fourth adhesive (6, 7) have contact with the pane element (5) as well as with the frame element (8); g) Activating the adhesion of the fourth adhesive (7) to bond the frame element (8) with the pane element (5). By this method even skewed parts, especially skewed frame element, can be mounted in their perfect position.

20 Claims, 9 Drawing Sheets

(56) References Cited

U.S. PATENT DOCUMENTS

Figure 1:
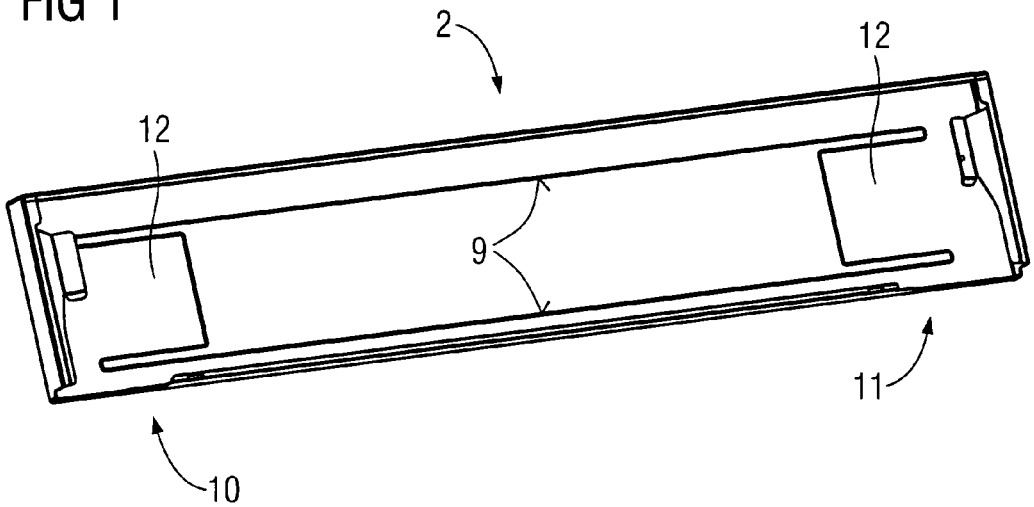

| | | | | |
|---|---|---|---|---|
| 2004/0169449 | A1 | 9/2004 | Kim | |
| 2005/0020175 | A1 * | 1/2005 | Tamashiro et al. | 445/24 |
| 2006/0082710 | A1 * | 4/2006 | Kitson | 349/139 |

FOREIGN PATENT DOCUMENTS

| | | | | | |
|---|---|---|---|---|---|
| EP | 1639935 | | 3/2006 | | |
| JP | 62035107 | A | * | 2/1987 | |
| JP | 2000193943 | A | * | 7/2000 | G02F 1/1333 |

OTHER PUBLICATIONS

JP 2000193943 A English abstract, Jul. 2000.*
JP 2000193943 A English machine translation, Jul. 2000.*
International Search Report for PCT/EP2011/002334, dated Jul. 29, 2011, 2 pages.

* cited by examiner

METHOD FOR MOUNTING A PANEL OF AN APPLIANCE, ESPECIALLY OF A DOMESTIC APPLIANCE

The invention relates to a method for mounting a panel of an appliance, especially of a domestic appliance.

It is well known in the art to produce panels of appliances, especially of domestic appliances like domestic ovens or washing machines, by manufacturing the different components of the panel which are then mounted to the complete panel unit. Those panels usually comprise a panel element as a basis element which is connected with a glass pane. After the assembly of the glass pane onto the panel element at least one frame element is mounted onto the surface of the glass pane.

A common method of joining the different components is the glueing of the components. Therefore, a certain amount of adhesive is applied onto one of the components; then the other component is arranged on the component which bears the adhesive. A pressing force is exerted onto the parts until the adhesive is cured (hardened). After that the mounting process can be continued.

Different solutions and variations are known in the art with respect to such a mounting process of an appliance, especially of a domestic appliance. Reference is made e. g. to DE 199 58 506 A1, DE 10 2007 017 971 A1, DE 10 2007 041 907 A1, EP 0 826 489 B1, and FR 2 747 436 A1.

Normally, usual adhesives are used for the connection of the different components which are joined by glueing. "Normally" means in this connection that adhesives are used which cure when being exerted to the air, i. e. to oxygen. Of course, this takes some time until the adhesive bonding has a sufficient power. Advantageously, no specific measures are necessary to establish the bonding.

On the other side, solutions are known which use adhesives which cure when exerted to an ultraviolet radiation (UV radiation). Advantageously, such a bonding cures in shorter time but required additional measures during the mounting process. Also the costs for such kind of adhesives can be higher.

A problem in connection with the assembly of panels of domestic appliances is the following: Sometimes it cannot be excluded that the shape of a component is perfectly given, i. e. that the form of the component is such of the ideal design. Distorsion of a component can take place and complicates the assembly process significantly. Therefore, is can be necessary to straighten a component prior assembly to obtain a sufficient quality of the panel. Obviously, this is time and cost consuming and thus detrimental.

An alternative is the joining of components by screwing. Obviously, the assembly work necessary for this process is high which makes this process costly.

Therefore, it is an object of the invention to propose a method for mounting a panel of an appliance of the kind mentioned above which allows a more precise and cost efficient assembly of the panel. More specifically, it is aimed that any straightening process of components of the panel is avoidable.

The solution of this object is characterized by a process which comprises the following steps:

a) Arranging of a panel element;
b) Applying a first adhesive and a second adhesive onto a surface of the panel element;
c) Pressing a transparent pane element against the surface of the panel element in a mounting position so that the first and the second adhesive have contact with the panel element as well as with the pane element;

d) Activating the adhesion of the second adhesive to bond the pane element with the panel element;
e) Applying a third adhesive and a fourth adhesive onto a surface of the pane element;
f) Pressing a frame element against the surface of the pane element in a mounting position so that the third and fourth adhesive have at least partially contact with the pane element as well as with the frame element;
g) Activating the adhesion of the fourth adhesive to bond the frame element with the pane element.

Preferably, the second and the fourth adhesive are activated in above steps d) and g) by means of a radiation source. The second and the fourth adhesive can be an adhesive which can be activated by ultraviolet radiation (UV radiation). The second adhesive can be activated in above step d) by irradiation via the transparent pane element.

The second and the fourth adhesive can also be an adhesive which can be activated by heat (hot melt adhesive).

Preferably, a pressing force between the panel element and the pane element according above step c) can be maintained at least partially during the activation of the adhesion of the second adhesive according above step d).

Also, a pressing force between the pane element and the frame element according above step f) can be maintained at least partially during the activation of the adhesion of the fourth adhesive according above step g).

The surface covered in above step b) with the first adhesive is preferably at least two times, specifically at least five times as big as the surface covered with the second adhesive. Also, the surface covered in above step e) with the third adhesive can be at least two times, preferably at least five times as big as the surface covered with the fourth adhesive.

The adhesives can be applied at least partially in substantial rectangular structures which are at least three times as long as broad.

During above step c) the adhesives can be arranged completely between the panel element and the pane element.

On the other hand, during above step f) the fourth adhesive can be arranged only partially between the pane element and the frame element, so that a part of the fourth adhesive remains uncovered by the frame element.

A frame element can be used which was not subject of a straightening process. Specifically, the frame element can have deviations from its ideal shape in an unstressed state.

The first and third adhesive are preferably not activatable by means of a radiation source; those adhesives are preferably such which cure when exerted to the air, i. e. to oxygen.

Advantageously, the proposed method allows that the components of the panel do not need any straightening process prior assembly. Even distorted plastic or metal components can be used without straightening. The straightening process takes place immanently during the proposed assembly process by glueing.

The process can be operated in an automated arrangement. Due to the quick hardening of an adhesive by means of UV radiation or heat no relevant waiting times are necessary.

Beneficially, not screwing operations are necessary even if strongly distorted components are used.

When transparent pane elements (from glass or plastic material) are used—as it is normally the case—is becomes possible that several areas provided with adhesives which are used for bonding can be cured simultaneously.

The arrangement can work fully automated, i. e. the components as well as the adhesives are handled by manipulating systems. Also the pressing forces are exerted automated until a sufficient curing process has taken place.

Thus, the invention allows a straightening process of distorted metal and plastic components which is done without any pre-process; the straightening process is carried out by glueing the distorted part in the mentioned way to a carrier element (panel element). For doing so the application of a UV curing adhesive or of a hot melt adhesive is suggested.

The whole panel can be assembled in one assembly arrangement. This also includes the assembly of all periphery parts like switches etc. The proposed sandwich design allows a quick assembly without relevant waiting times for the bonding of two parts by means of an adhesive.

The curing of several areas applied with adhesive (UV adhesive or hot melt adhesive) can be carried out when curing by a radiation source via a transparent pane.

The assembly process becomes also more cost efficient because the handling of the different components is facilitated. The parts must be handled only once, as no straightening process is required before assembly.

In the drawings embodiments of the invention are depicted.

Figure 2:
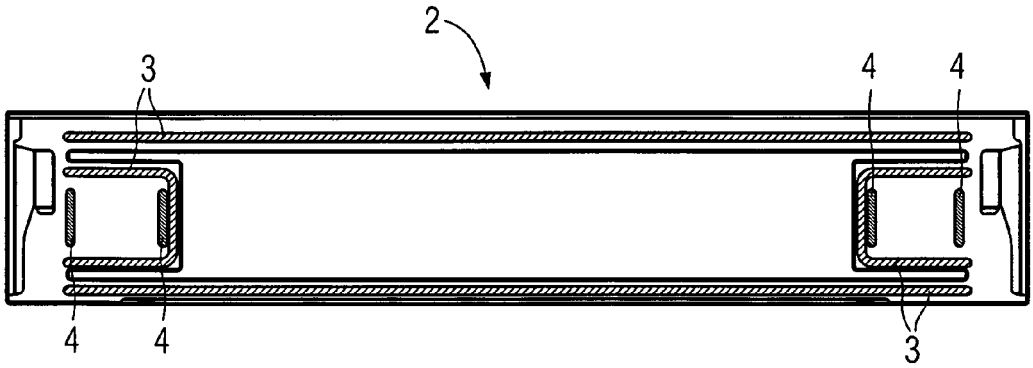
Figure 3:
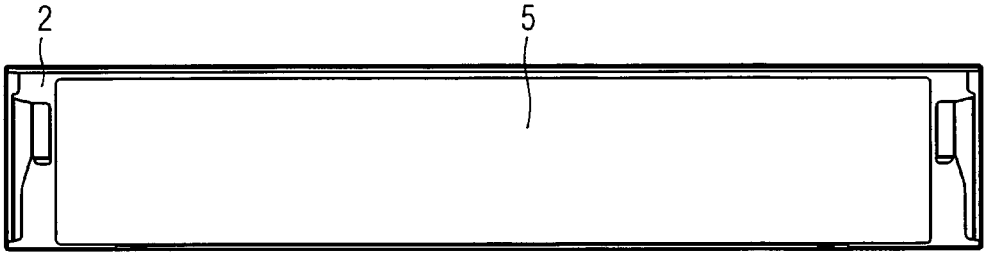
Figure 4:
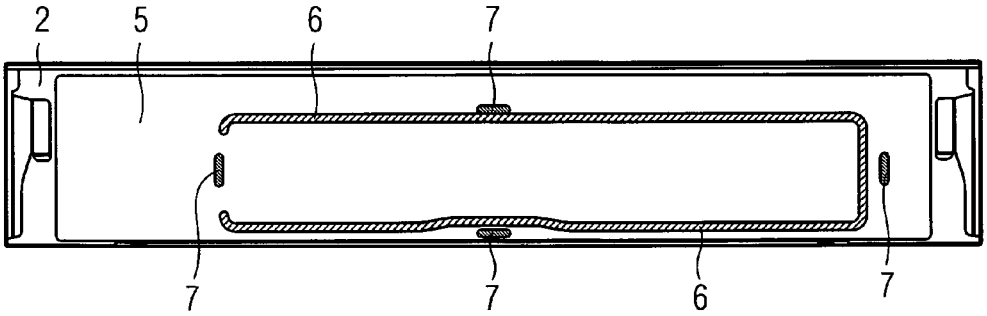
Figure 5:
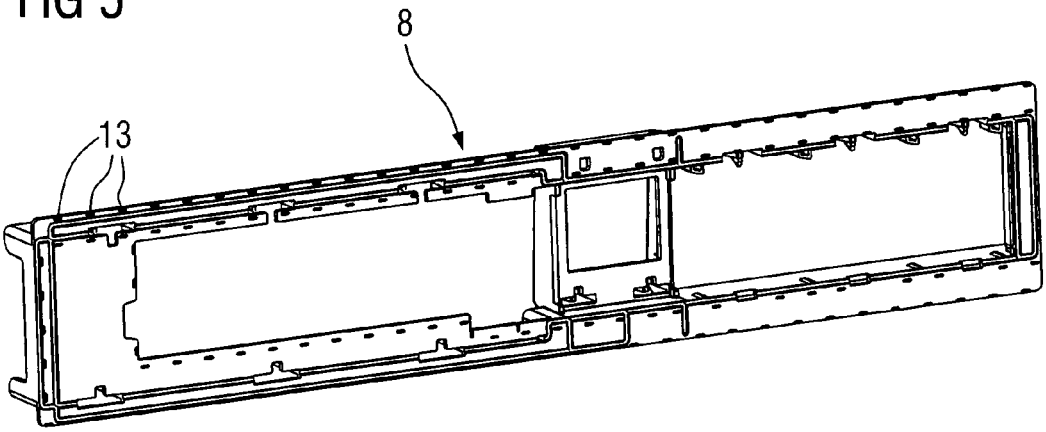
Figure 6:
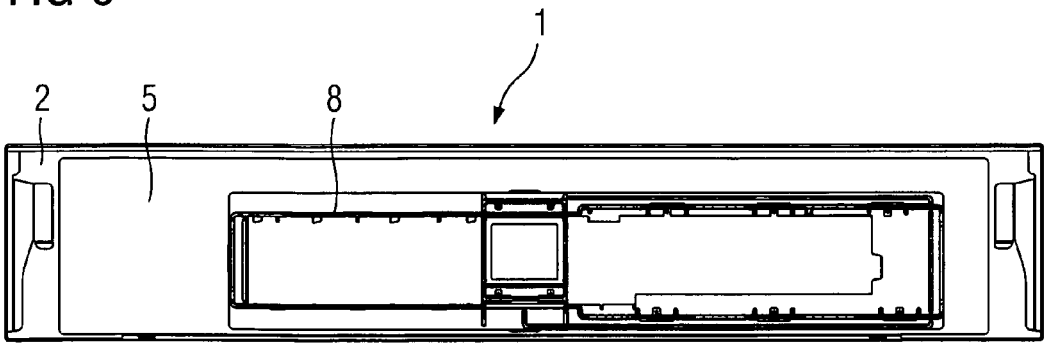
Figure 7:
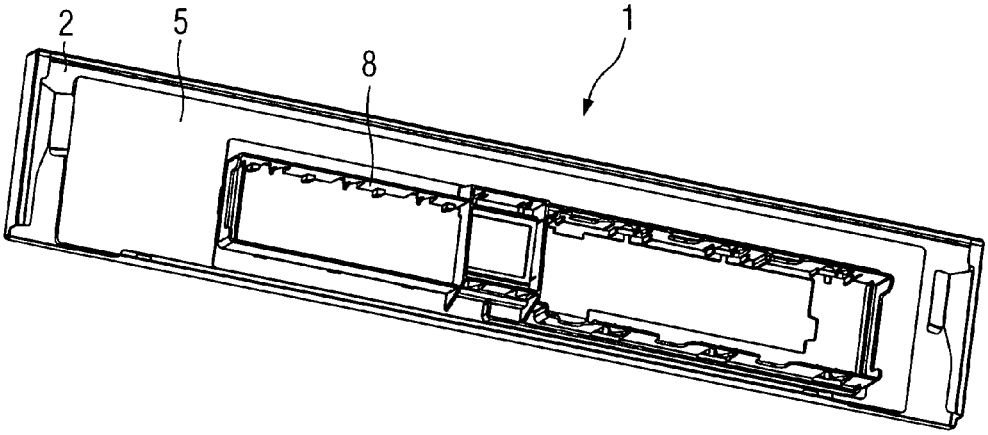
Figure 8:
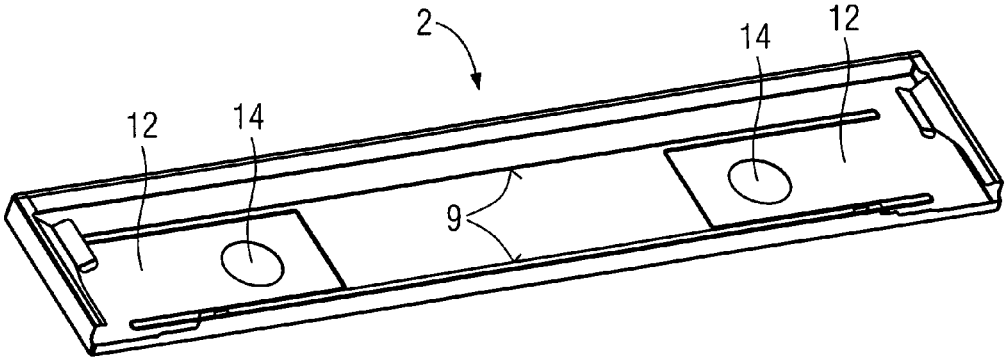
Figure 9:
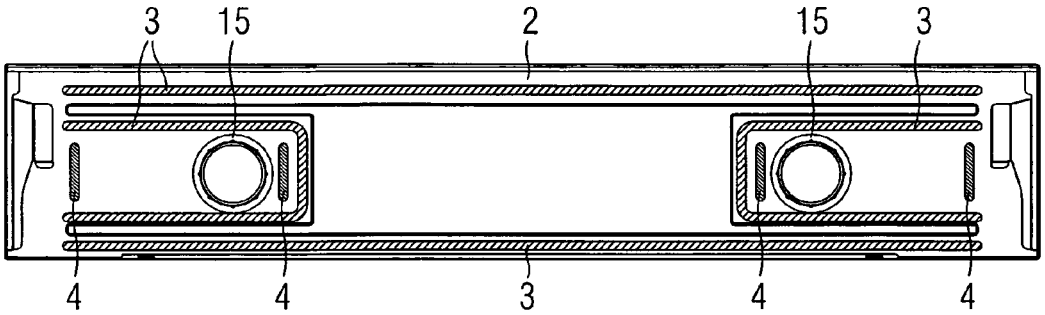
Figure 10:
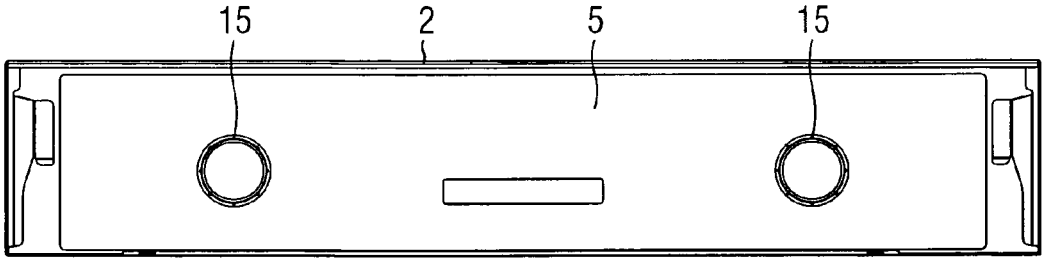
Figure 11:
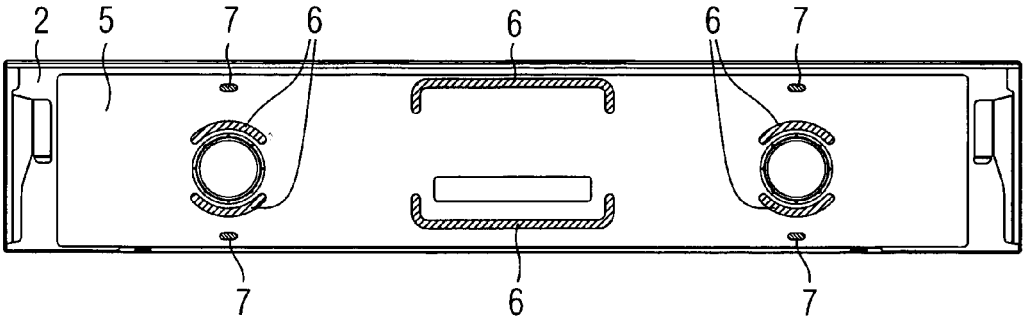
Figure 12:
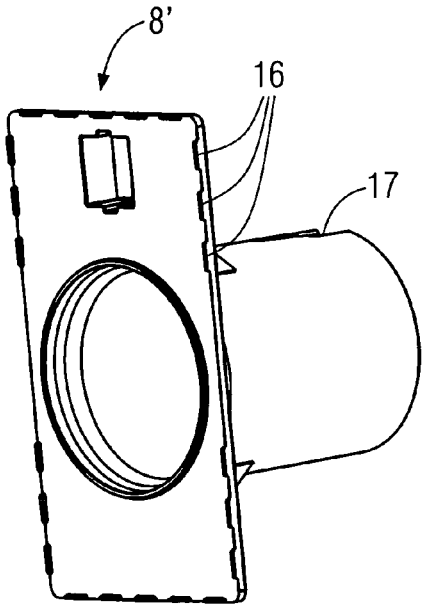
Figure 13:
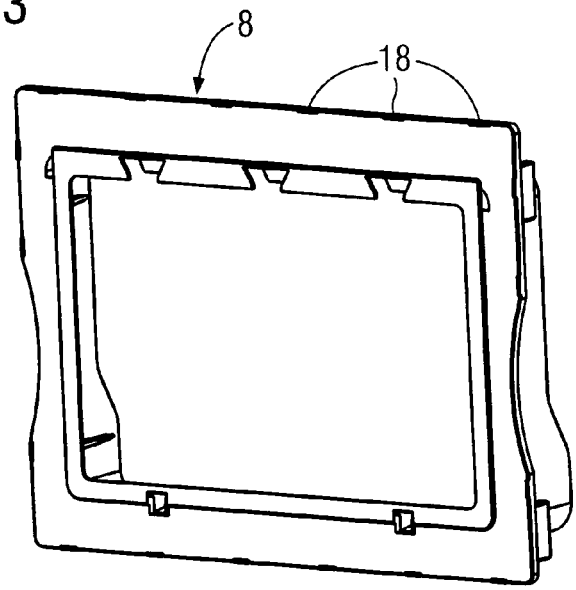
Figure 14:
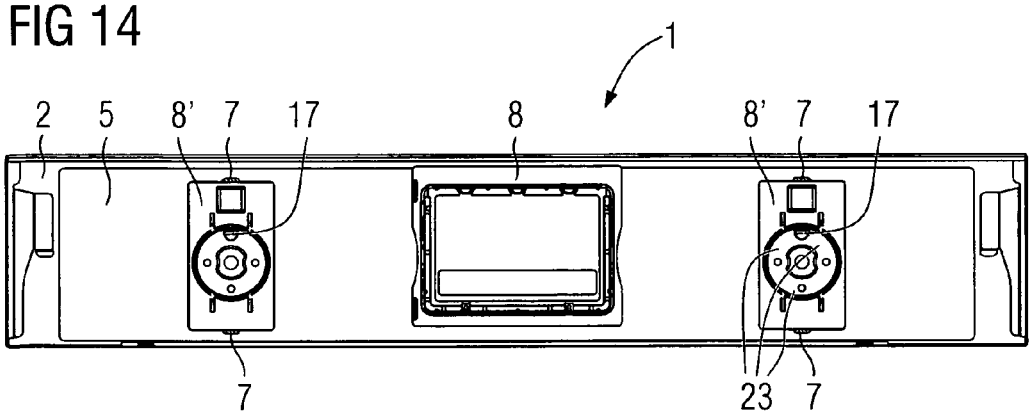
Figure 15:
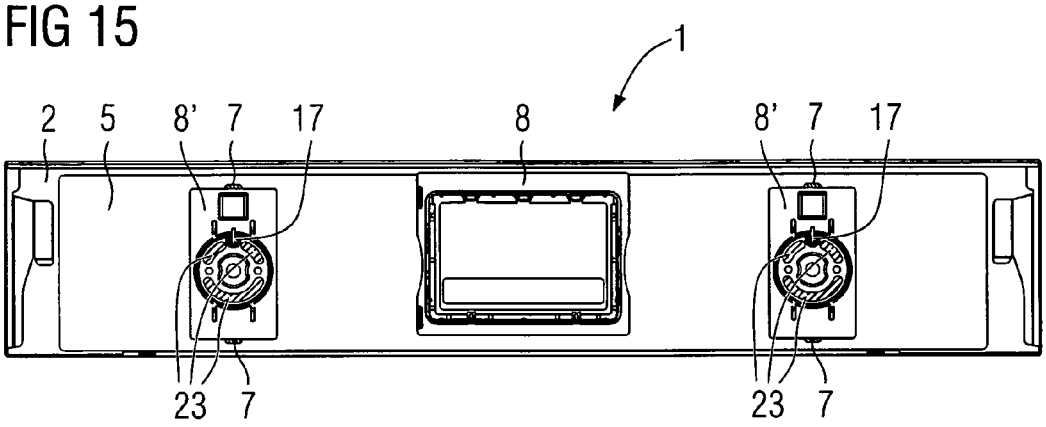
Figure 16:
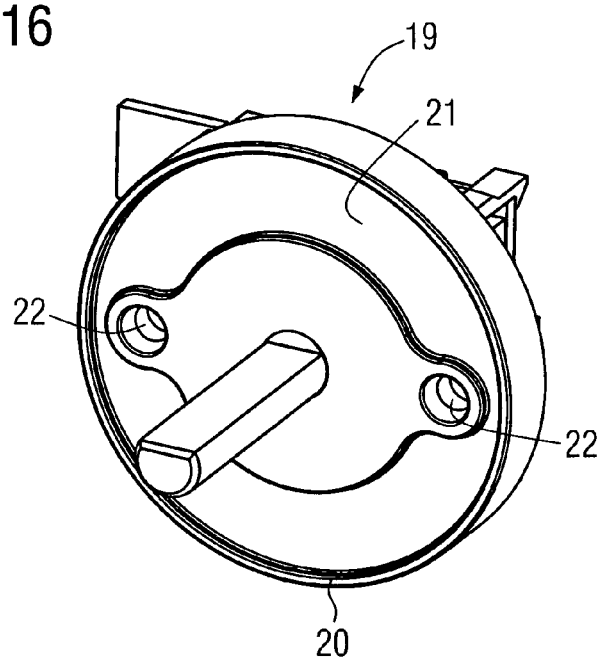
Figure 17:
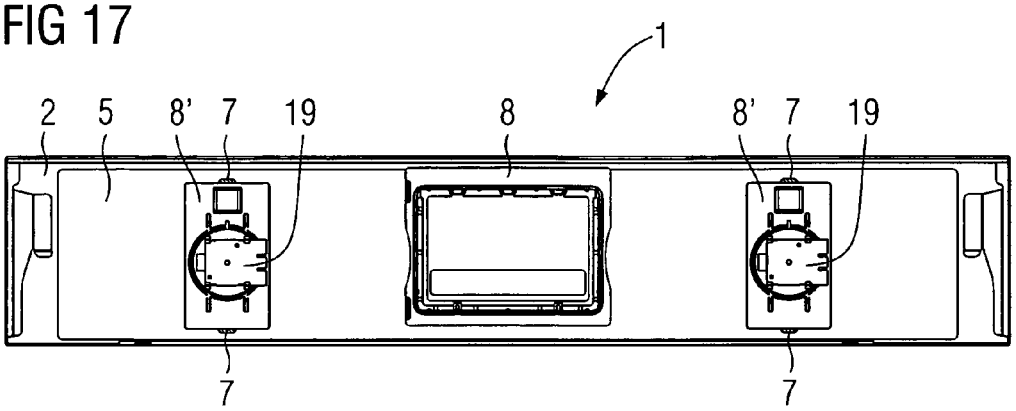

FIG. 1 to FIG. 7 show a first embodiment of the invention, namely:

FIG. 1 shoes a perspective view of a panel element,

FIG. 2 shows a front view of the panel element, on which two kinds of adhesive are applied, FIG. 3 shows a front view of the panel element according to FIG. 2 on which a pane element is mounted, FIG. 4 shows a front view of the panel and pane element, wherein two kinds of adhesive are applied onto the pane element, FIG. 5 shows a perspective view of a frame element which is to be mounted onto the pane element, FIG. 6 shows a front view of the whole panel with mounted pane element and frame element, FIG. 7 shows a perspective view of the panel according to FIG. 6, FIG. 8 to FIG. 17 show a second embodiment of the invention, namely:

FIG. 8 shoes a perspective view of a panel element,

FIG. 9 shows a front view of the panel element, on which two kinds of adhesive are applied, FIG. 10 shows a front view of the panel element according to FIG. 9 on which a pane element is mounted, FIG. 11 shows a front view of the panel and pane element, wherein two kinds of adhesive are applied onto the pane element, FIG. 12 shows a perspective view of a switch housing which is to be mounted onto the pane element, FIG. 13 shows a perspective view of a frame element which is to be mounted onto the pane element, FIG. 14 shows a front view of the panel with mounted pane element and frame element, FIG. 15 shows a front view of the panel with mounted pane element and frame element, wherein an adhesive is applied for mounting a switch element, FIG. 16 shows a perspective view of a switch element which is to be mounted onto the panel according to FIG. 15 and FIG. 17 shows a perspective view of the whole panel.

In FIG. 1 a panel element 2 is shown which forms a frame of the whole panel of a domestic appliance, e. g. of a domestic oven. The panel element 2 is made of sheet metal and has a cutout 9 which defines the area which is visible during normal use of the appliance. In the side regions 10 and 11 of the panel element 2 flaps 12 are formed.

In FIG. 2 is can be seen that preparations have been carried out for mounting a pane element onto the panel element 2. More specifically, a first adhesive 3 (which is an oxygen curing adhesive) and a second adhesive 4 (which is a UV curing adhesive) are applied onto the surface of the panel element 2. As can be seen the adhesives 3, 4 are applied with a lamellar shape which is substantially rectangular. Also the amount of the first adhesive 3 is substantially bigger than the amount of the second adhesive 4.

As said, the second adhesive 4 is an UV curing adhesive in the embodiment according FIG. 2. This means that the second adhesive is curing when exerted to a UV radiation source. In distinction to that, the first adhesive 3 is an adhesive which cures when exerted to air, i. e. to oxygen.

After the adhesives 3, 4 are applied onto the panel element 2 a transparent pane element 5 is pressed against the surface of the panel element 2 so that the adhesives 3 and 4 have contact to both elements 2 and 5. This is shown in FIG. 3. Now an UV radiation source which is arranged behind the panel element 2 in FIG. 3 (not visible) is activated. Thus, the UV curing adhesive 4 is cured quite quickly (e. g. within 5 seconds) so that a firm bond exists between the parts 2 and 5. Thus, there is no need to wait until the air-curing adhesive 3 has bonded the parts 2 and 5.

To the contrary, the assembly process can continue immediately after curing of the adhesive 4. More specifically, the joining of a frame element 8 (see FIG. 5) can be prepared what is depicted in FIG. 4. A third adhesive 6 and a fourth adhesive 7 are applied onto the surface of the pane element 5. Again the third adhesive 6 is an air-curing adhesive while the fourth adhesive 7 is an UV curing adhesive.

Now, the frame element 8 is pressed onto the surface of the pane element 5 as shown in FIG. 6. Again, a UV radiation source is activated which cures the adhesive 7 by a radiation which reaches the adhesive 7 via the glass pane element 5.

The finished panel 1 is shown in FIG. 7. Here, the panel element 2, the pane element 5 and the frame element 8 are connected via adhesives. It should be mentioned that any possible distorsion of the pane element 5 and/or the frame element 7 is eliminated due to the described bonding method. This is specifically true even if any straightening process of the parts 5, 8 prior to assembly is dispensed. This is, even in the case that the pane element 5 and/or frame element 8 has had distorsions before assembly they are now eliminated and the parts are now perfectly flat after assembly.

Also the mounted parts cannot be moved relative to another after the adhesive 4, 7 have been activated.

The assembly process is carried out by using a respective mounting device which is not depicted.

The size of the area covered with adhesive 3, 4, 6, 7 and the amount of adhesive depends on the specific shape and size of the parts and is selected accordingly. Thereby, any gap should be avoided.

Also contact pimples 13 of the frame element 8 (see FIG. 5) define the area and amount of the adhesive necessary for a firm bonding.

A second alternative example is shown in FIG. 8 till FIG. 17.

The panel element 2 is shown in FIG. 8. Here the flaps 12 are provided with circular shaped openings 14 for the passage of switching elements.

In FIG. 9 the analogous situation to FIG. 2 is shown. Onto the surface of the panel element 2 a first adhesive 3 and a second adhesive 4 is applied. Prior to this operation step guiding element 15 have been mounted into the openings 14 for guiding the switch elements.

As can be seen in FIG. 10 a pane element 5 is then pressed onto the panel element 2 as shown in FIG. 3.

Analogous to FIG. 4 a third adhesive 6 and a fourth adhesive 7 is the applied onto the surface of the pane element 5 as shown in FIG. 11.

This is done to bond frame elements 8 and 8' as shown in FIG. 12 and FIG. 13. The frame element 8' according FIG. 12 is a housing element for a switch element which must be connected with the pane element 5. The frame element 8' has pimples 16 which contact the pane element 5. Also illumination means 17 can be provided in the frame element 8'. The frame element 8 according FIG. 13 has also pimples 18 for contacting the pane element 5.

After the frame elements 8 and 8' are placed on the surface of the pane element 5 the constellation is reached as shown in FIG. 14. It should be recognized that the fourth adhesive 7 is applied in such a manner that only a part of the adhesive 7 is placed between the pane element 5 and frame element 8'; a part of the adhesive stays uncovered after placing the frame element 8'. This allows that a part of the adhesive is acting as a burling element which secures the frame element 8' against movement in the plane of the pane element 5 when cured. Consequently, the fixation of the frame element 8' is improved and guaranteed after curing of the fourth adhesive 7. This is again established by the application of a UV radiation source. The radiation is again applied be radiating through the transparent pane element 5.

The illumination means 17 are inserted into a corresponding reception in the frame element 8' After fixation of the frame element 8' on the pane element 5 the illumination means 17 are secured in the frame element 8'.

Finally, a switch element 19 has to be mounted. The switch element 19 as such is shown in FIG. 16. It has an edge 20 which creates a recessed region 21 of the frame element 8' and thus a definite contact area between the switch element 19 and the frame element 8'.

Additionally (optionally) through holes 22 can be supplied for a screw connection between the switch element 19 and the frame element 8'.

Before placing the switch element 19 into its final position onto the panel 1 a fifth adhesive 23 is applied onto the carrier surface of the frame element 8', see FIG. 15.

Then the switch element 19 is pressed into its final location on the frame element 8' as shown in FIG. 17. The fifth adhesive is a usual of normal type as normally no straightening process is necessary for the switch element 19.

Thereby, the assembly of the panel 1 is terminated.

As an alternative to the UV-curing adhesive also a hot melt adhesive can be employed. Also, adhesives containing silicone have proven which can also be cured by UV radiation.

The curing time for the second and fourth adhesives, i. e. for those adhesives which are cured by exertion of UV radiation, is preferably between 3 and 7 seconds, specifically about 5 seconds. Several applied adhesives can be cured simultaneously by applying the UV radiation to the adhesive via the transparent pane element.

After the curing of the second and fourth adhesives for the mentioned short time the following assembly steps can follow immediately. Thus, the assembly time can be minimized and carried out in a very cost efficient manner.

REFERENCE NUMERALS

1 Panel
2 Panel element
3 First adhesive
4 Second adhesive
5 Pane element
6 Third adhesive
7 Fourth adhesive
8 Frame element
8' Frame element
9 Cutout
10 Side region
11 Side region
12 Flap
13 Pimple
14 Opening
15 Guiding element
16 Pimple
17 Illumination means
18 Pimple
19 Switch element
20 Edge
21 Recessed region
22 Through hole
23 Fifth adhesive

The invention claimed is:

1. A method for mounting a panel of an appliance, comprising at least one of an oven and a washing machine, comprising the steps of:

a) providing a panel element;

b) applying a first adhesive and a second adhesive onto a surface of the panel element;

c) pressing a transparent pane element against the surface of the panel element in a mounting position so that the first and the second adhesive have contact with the panel element as well as with the pane element;

d) activating the adhesion of the second adhesive to bond the pane element with the panel element;

e) applying a third adhesive and a fourth adhesive onto a surface of the pane element;

f) pressing a frame element against the surface of the pane element in a mounting position so that the third and fourth adhesive have contact with the pane element as well as with the frame element, wherein the step of pressing the frame element comprises straightening the frame element, and while the frame element is straightened, g) activating the adhesion of the fourth adhesive to bond the frame element with the pane element, wherein the frame element is distorted prior to step f), and wherein straightening the frame element changes the shape of the frame element such that after step g), the frame element is not distorted.

2. The method according to claim 1, wherein the second and the fourth adhesive are activated in steps d) and g) by means of a radiation source.

3. The method according to claim 1, wherein the second and the fourth adhesive are an adhesive which can be activated by ultraviolet radiation (UV radiation).

4. The method according to claim 1, wherein the second adhesive is activated in step d) by irradiation via the transparent pane element.

5. The method according to claim 1, wherein the second and the fourth adhesive are an adhesive which can be activated by heat.

6. The method according to claim 1, wherein a pressing force between the panel element and the pane element according to step c) is maintained at least partially during the activating of the adhesion of the second adhesive according to step d).

7. The method according to claim 1, wherein a pressing force between the pane element and the frame element according to step f) is maintained at least partially during the activating of the adhesion of the fourth adhesive according to step g).

8. The method according to claim 1, wherein the surface covered in step b) with the first adhesive is at least two times as big as the surface covered with the second adhesive.

9. The method according to claim 1, wherein the surface covered in step e) with the third adhesive is at least two times as big as the surface covered with the fourth adhesive.

10. The method according to claim 1, wherein the first, second, third, and fourth adhesives are applied at least partially in substantial rectangular structures which are at least three times as long as broad.

11. The method according to claim 1, wherein during step c) the first and second adhesives are arranged completely between the panel element and the pane element.

12. The method according to claim 1, wherein during step f) the fourth adhesive is arranged only partially between the pane element and the frame element, so that a part of the fourth adhesive remains uncovered by the frame element.

13. The method according to claim 1, wherein the frame element is used which was not subject of a straightening process prior to the straightening of step f).

14. The method according to claim 1, wherein the step of pressing the transparent pane element comprises straightening the panel element, and while the panel element is straightened, performing step d), wherein the panel element is distorted prior to step c), and wherein straightening the panel element changes the shape of the panel element such that after step d), the panel element is not distorted.

15. The method according to claim 14, wherein the panel element is skewed prior to step c), and wherein straightening the panel element changes the shape of the panel element such that after step d), the panel element is not skewed.

16. The method according to claim 14, wherein the panel element comprises a deviation from a desired shape of the panel element prior to step c), and wherein straightening the panel element changes the shape of the panel element to the desired shape such that after step d), the panel element does not comprise the deviation.

17. The method according to claim 1, wherein the first and third adhesive are not activatable by means of a radiation source.

18. The method according to claim 1, wherein at least one of the surface covered in step b) with the first adhesive is at least five times as big as the surface covered with the second adhesive and the surface covered in step e) with the third adhesive is at least five times as big as the surface covered with the fourth adhesive.

19. The method according to claim 1, wherein the frame element is skewed prior to step f), and wherein straightening the frame element changes the shape of the frame element such that after step g), the frame element is not skewed.

20. The method according to claim 1, wherein the frame element comprises a deviation from a desired shape of the frame element prior to step f), and wherein straightening the frame element changes the shape of the frame element to the desired shape such that after step g), the frame element does not comprise the deviation.

* * * * *